US005794844A

United States Patent [19]

Jenkins

[11] Patent Number: 5,794,844

[45] Date of Patent: Aug. 18, 1998

[54] MULTI-POINT LOCKING SYSTEM

[75] Inventor: Kenneth W. Jenkins, Auburndale, Fla.

[73] Assignee: Cutler Manufacturing Corporation, Lakeland, Fla.

[21] Appl. No.: 779,821

[22] Filed: Jan. 7, 1997

[51] Int. Cl.[6] ..... B65D 91/00

[52] U.S. Cl. ..... 232/25; 292/120; 292/DIG. 72

[58] Field of Search ..... 292/120, 117, 292/136, DIG. 72; 232/24, 25, 26, 27, 39; 312/216

[56] References Cited

U.S. PATENT DOCUMENTS

| | | | |
|---|---|---|---|
| 1,563,880 | 1/1925 | Vance | 292/120 |
| 1,661,370 | 3/1928 | Kaser | 292/120 X |
| 4,508,779 | 4/1985 | Sasaki | 292/DIG. 72 |

FOREIGN PATENT DOCUMENTS

| | | |
|---|---|---|
| 297215 | 9/1928 | United Kingdom . |

*Primary Examiner*—Blair Johnson

*Attorney, Agent, or Firm*—Stein, Schifino & Van Der Wall

[57] ABSTRACT

The invention comprises a multiple point latching system for use with postal box clusters. In particular, the multiple point latching system comprises a latch bar, a track member, a plunger assembly and a plurality of latch plates. The latch bar is slidably coupled relative to a center partition in the postal box and includes a plurality of latches thereon. The latch bar slides in a vertical movement within a track member which is coupled to the center partition of the postal box. The plurality of latches on the latch bar present a plurality of latch points which aggregate to achieve the securement of the postal box cluster. The multiple point latching system further comprises a plunger assembly which is coupled to the center partition and which supplies a force that acts upon at least one master door to thereby force at least one master door open upon an unlatching of the latches. Hence, a single lock having multiple latch points is used to access and subsequently secure the entire postal box cluster.

13 Claims, 6 Drawing Sheets

MULTI-POINT LOCKING SYSTEM

BACKGROUND OF THE INVENTION

1. Field of the Invention

This invention relates to a latching system and, more particularly, to a multiple point latching system for use on a postal box cluster.

2. Description of the Background Art

Presently, many types of latching systems are known and are in wide use today throughout the postal box industry. Usually these latching systems are used on a multiple unit mailbox system that contains a cluster of individual mail slots to be used by a number of homes or apartments living in a relative or close proximity. A problem that is encountered by the prior art mailbox clusters is related to gaining access to the cluster of mailboxes simultaneously so that the postal service can deliver or deposit mail therein. Many of the prior art mailbox designs require an individual unlocking of each mail slot so as to deposit mail therein. Some of the prior art mailbox clusters do allow for the unlocking of a single or double door which in turn results in providing simultaneous access to the cluster of mailboxes. However, those latching systems of the prior art that generally provide for simultaneous access, are complicated, cumbersome, provide access through the rear and require the performance of multiple steps to gain access. Furthermore, the latching systems currently used in those prior art mailbox clusters generally provide a weak securement of the master door since there is only one latch point that serves to secure the master door. Therefore, the mailbox clusters currently in use have a high degree of vulnerability associated with them as to being broken into and having mail stolen.

Some representative prior art latching systems and multiple unit mailboxes are disclosed in U.S. Pat. No. 4,416,413; 4,533,165 and 4,557,416, the disclosures of which are hereby incorporated by reference herein. The disclosure in U.S. Pat. No. 4,416,413, issued to Chester, discloses generally a post office locker having a latching mechanism for each individual locker whereby, upon gaining access to the locker and thereafter closing the locker door, the access key is retained in the latching mechanism. Subsequent removal of the access key is obtained only by the postal service worker. Thus, access to individual mail slots is achieved one at a time in an individual fashion.

In U.S. Pat. No. 4,533,165, issued to Edelman, a latching system for releasably locking a door to a housing is disclosed whereby a hook and keeper pin is utilized to accomplish the engagement. In Edelman, a keeper pin is located relative to a handle that is mounted on a pivotable point to pull back on the keeper pin once the keeper pin is engaged with the hook to forcibly preserve the engagement. Once again, the disclosure in Edelman teaches a single lock for each door and further involves only a single latch point to achieve the securing of the door.

In U.S. Pat. No. 4,557,416, issued to Stahl, et al., a multiple unit mailbox is disclosed having a front panel that contained a plurality of openings in a spaced relationship from each other for receiving mail therein. Each opening further included a hinged door assembly that was comprised of an individual door that was hingedly fixed to a rod that ran the vertical length of the front panel. Once again, Stahl taught a mailbox cluster wherein each individual compartment required a separate lock and access to each compartment was achieved in a singular fashion.

While the above-referenced latching systems and mailbox clusters operate sufficiently to provide a multiplicity of mail slots that are individually locked, there still remains the disadvantage of having to access each mail slot in an individual manner. In addition, there still remains the problem of having a complicated access routine to gain entry into the mailbox cluster when a single master panel door is present. Further, the locked integrity of the mailbox cluster, in general, is inadequate in that only one latch point is utilized to achieve the securement of the master door. Therefore, the current prior art mailbox clusters that utilize a master door type of concept, are susceptible to being broken into and having mail stolen.

Therefore, it is an object of this invention to provide an improvement which overcomes the aforementioned inadequacies of the prior art devices and provides an improvement which is a significant contribution to the advancement of the latching system art used on postal boxes.

Another object of this invention is to provide a multiple point latching system whereby the master door is secured in the closed position by way of a plurality of latches thereby providing a mailbox cluster having a high degree of security so to minimize the potential for being broken into.

Another object of this invention is to provide a multiple point latching system that can provide easy simultaneous access to all the mail slots in a mailbox cluster commonly used in apartment complexes and housing developments.

Another object of this invention is to provide a multiple point latching system for use on postal boxes that provides for the use of only one lock to unlock all of the mailbox cluster.

Another object of this invention is to provide a multiple point latching system for use on postal boxes whereby a master door is automatically forced open upon being unlatched.

Another object of this invention is to provide a multiple point latching system for use on postal boxes that requires only a simple push on the master door to effectively close the entire mailbox cluster in a secured state.

Another object of this invention is to provide a multiple point latching system for use on a postal box, the postal box having one of a vertical side and an opposite vertical side, a first master door hingedly coupled along the one vertical side of the postal box, a second master door hingedly coupled along the opposite vertical side of the postal box, and a center partition positioned within the postal box whereby the first and second master doors close so to meet adjacent the center partition, the latching system comprising in combination: a track means for providing slidable movement therealong, the track means being coupled to the center partition of the postal box; a latching means for securing at least one master door in a closed position, the latching means being slidably coupled to the track means and having a plurality of latches thereon; and a plunger means for providing a force to forcibly open at least one master door upon the latching means being slid upwards.

The foregoing has outlined some of the pertinent objects of the invention. These objects should be construed to merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a multiple point latching system for use with postal box clusters. More particularly, the multiple point latching system comprises a latch bar, a track member, a plunger assembly and a plurality of latch plates. The latch bar is slidably coupled relative to the center partition of the postal box and the latch bar includes a plurality of latches thereon. The track member is coupled vertically along the center partition and serves to slidably receive the latch bar therein. The plunger assembly is coupled to the center partition also and supplies a force which acts upon at least one master door to force at least one master door open upon upward movement of the latch bar. The plurality of latch plates are positioned on at least one master door in relative alignment so to cooperate with the respective plurality of latches positioned on the latch bar.

The actual opening of the postal box is achieved by an upward movement of the latch bar which in turn results in each of the latches being disengaged from their respective latch plates and the plunger assembly forcibly moving at least one master door open. Upon the master door opening, the latch bar can be released so to slide down to its resting position without a possibility of re-engaging the latches with the latch plates.

An important feature of the present invention is that the latching system herein utilizes multiple points of engagement to secure the master doors.

Another important feature of the present invention is that the multiple point latching system for use with a postal box cluster is that it provides for simultaneous access to all the mail slots without having to individually open a lock for each mail slot.

Another important feature of the present invention is that the multiple point latching system requires the use of only one lock to secure the mailbox cluster.

Another important feature of the present invention is that the multiple point latching system for use with a mailbox cluster provides for an automatic opening of the master door upon being unlatched so as to prevent a re-engagement of the latches upon the release of the latch bar and its return to its locked position.

Another important feature of the present invention is that the multiple point latching system for use with a mailbox cluster provides for a quick and easy one-step method of closing the master doors in a secured manner.

Therefore, it can be readily appreciated that the present invention overcomes the inadequacies in the prior art latching systems as used on mailbox clusters and provides an overall high degree of security to the mailbox cluster.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
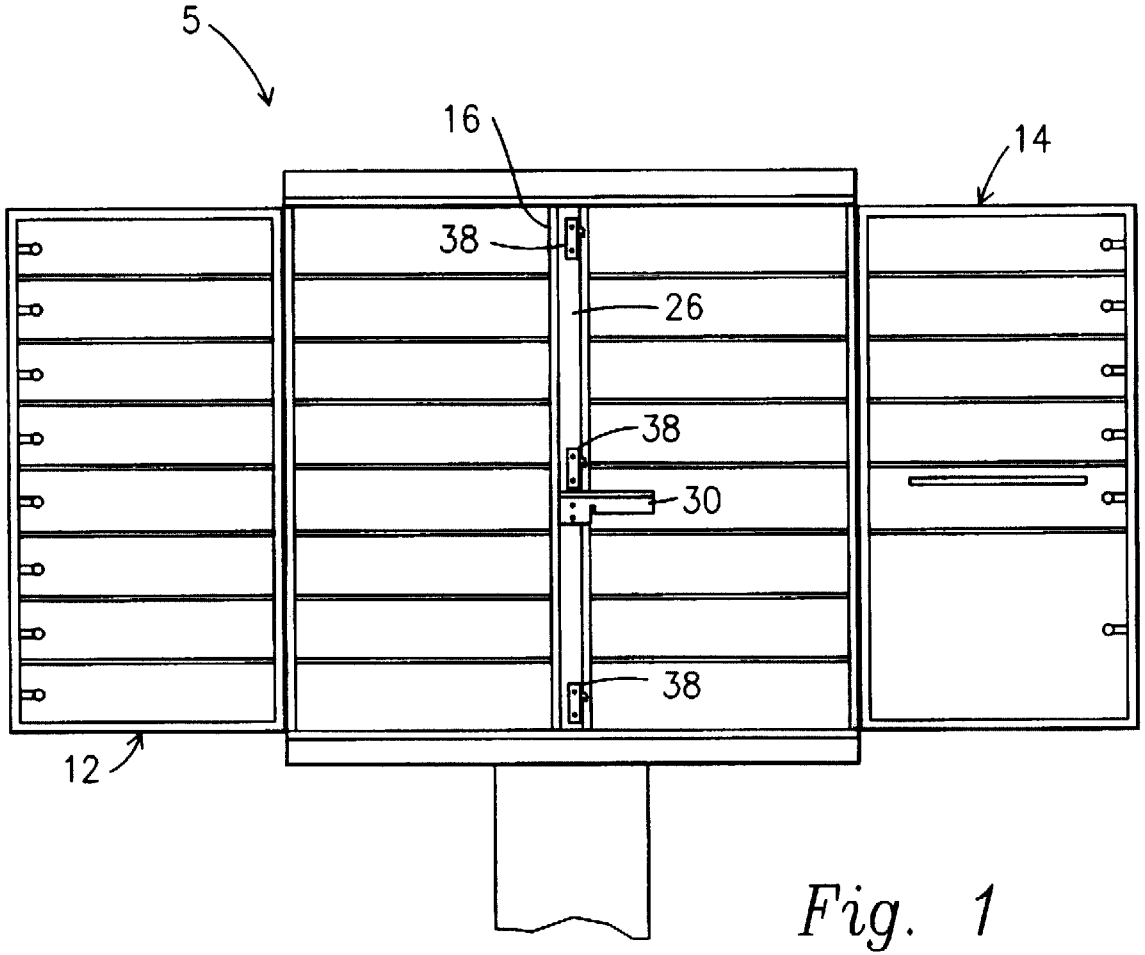
FIG. 1 is a front plan view of the postal box showing the center partition, the first and second master doors, and the track member in their relative positions.

As shown in FIG. 1, a front plan view of the postal box 5 showing the center partition 10, the first second master doors 12 and 14, and the tripping member 16 in their relative positions. The postal box 5 can be made of sturdy and rigid plastic material as well as a metal of some sort. Preferably, the postal box 5 is formed from an alloy, such as aluminum, so as to be noncorrosive. With the first and second master doors 12 and 14 in the open state, the individual mail slots can be seen in the postal box 5. The first master door 12 has a first locking edge 13 that engages a second locking edge 15 positioned on the second master door 14 when the first and second master doors 12 and 14 are in the closed state. Thus, by locking the second master door 14 in the closed state, the first master door 12 is resultingly secured by way of the first locking edge 13 being engaged by the second locking edge 15 of the second master door 14.

Figure 2A:
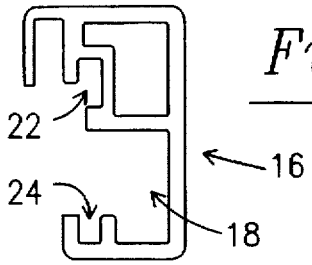
FIG. 2*a* is a top view of the track member illustrating the channel portion, and the first and second notches in their relative positions to each other.
Figure 2:
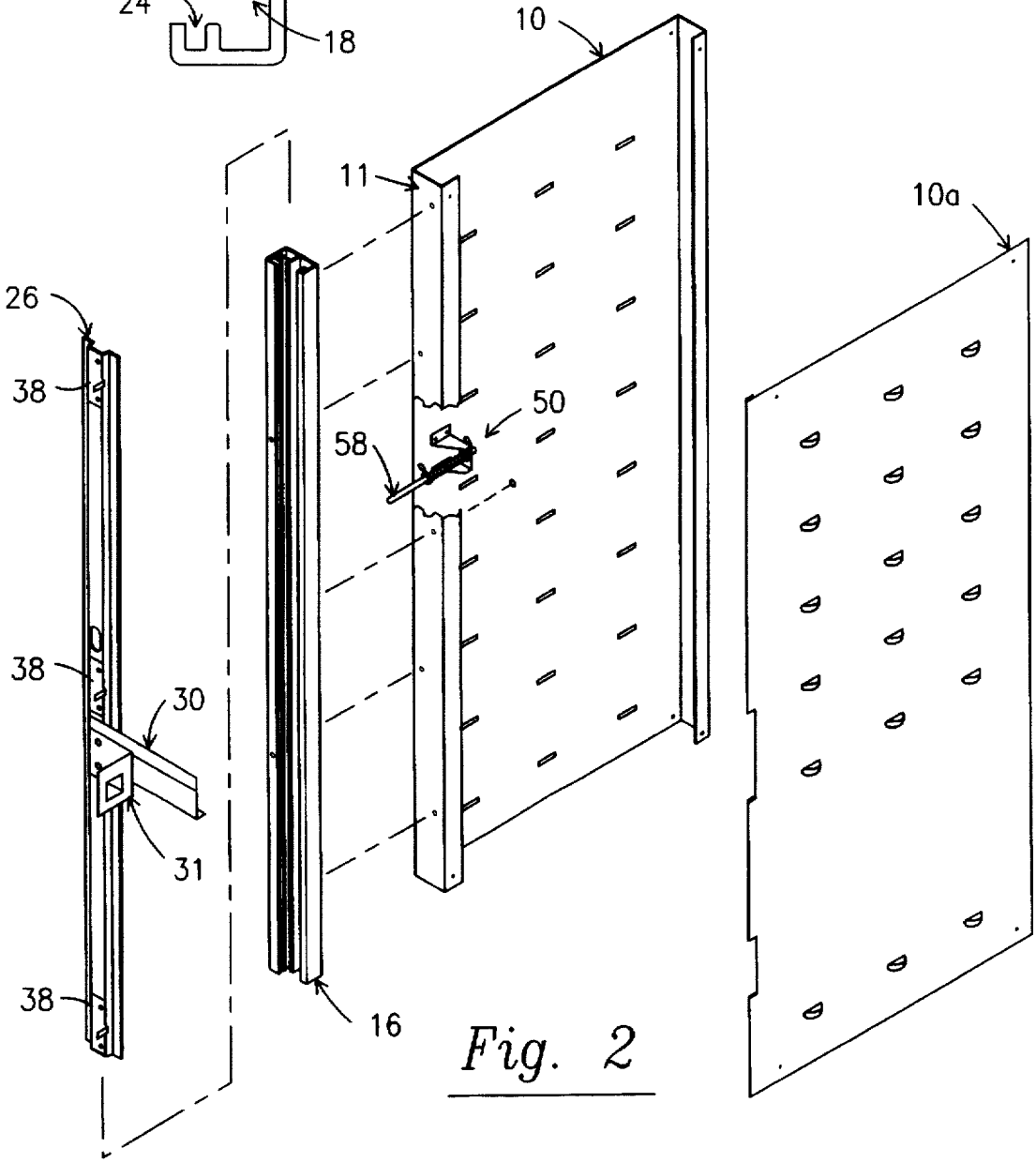
FIG. 2 is an assembly view illustrating the center partition, the plunger assembly, the track member, and the latch bar in their relative positions to each other.

In referring now to FIGS. 2 and 2*a*, a detailed assembly view of the center partition 10 having a plunger assembly 50, the track member 16, and the latch bar 26 all coupled relative thereto. The center partition 10 includes a first edge 11 whereupon the track member 16 is coupled thereto. The track member 16 is coupled by way of conventional standard bolts used commonly in the industry. The track member 16 includes a channel portion 18, a first notch 22, and a second notch 24 (see FIG. 2*a*). The channel portion 18 is positioned and runs along the longitudinal axis of the track member 16. The first notch 22 is positioned opposite the second notch 24 so as to be in alignment therewith. The track member 16 is preferably formed by way of an extrusion process so as to be constructed of a single one-piece unit. The first and second notches 22 and 24, being in alignment with each other, cooperate to receive the latch bar 26 therein.

Figure 3:
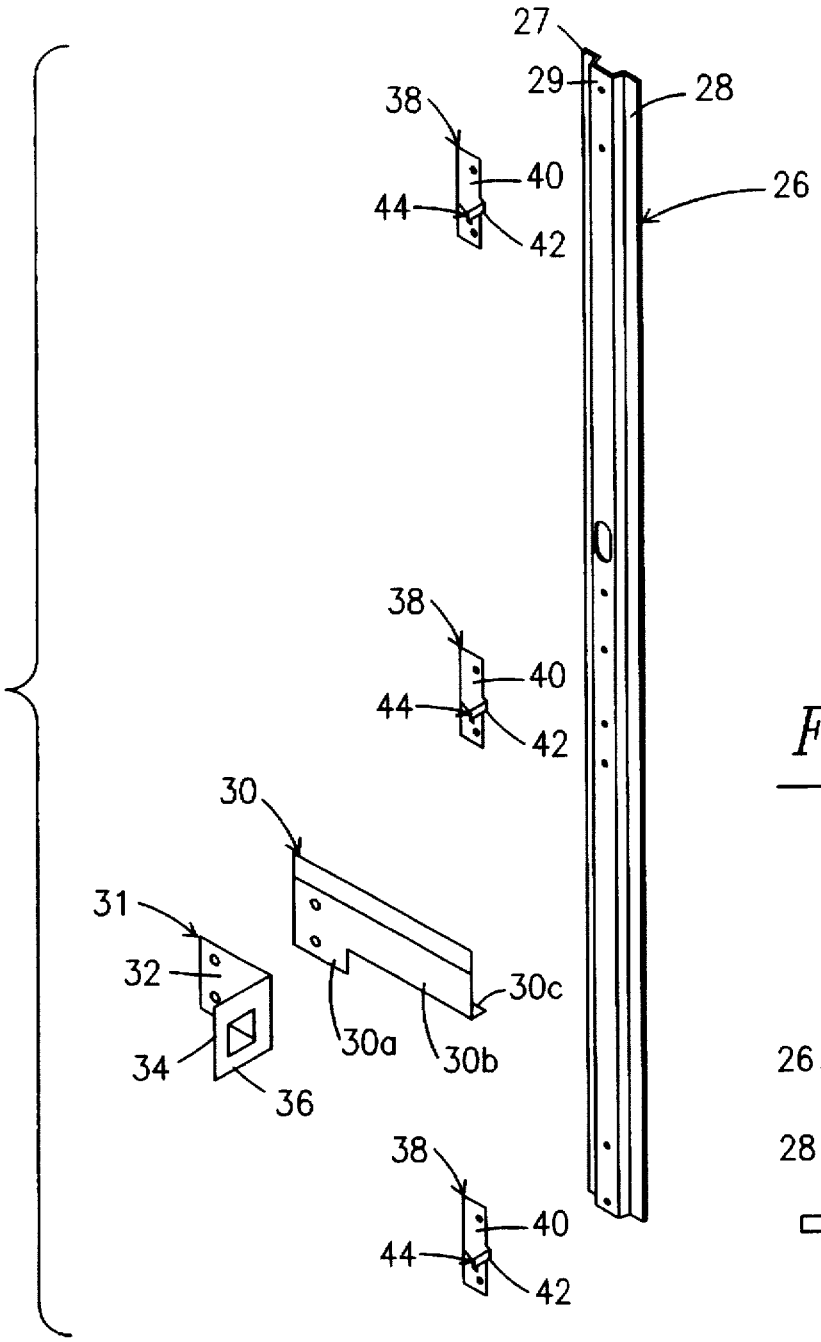
FIG. 3 is a detailed assembly drawing of the latch bar illustrating the relative positions of the latches, the latch handle and the oval slit to each other.
Figure 3A:
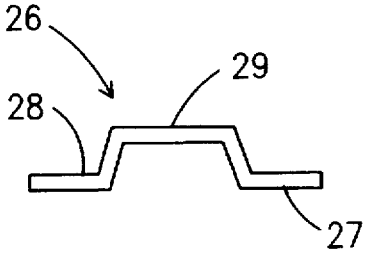
FIG. 3*a* is top view of the latch bar illustrating the relative positions of the first side flange, the second side flange and the mid portion to each other.

Referring to FIGS. 2, 3 and 3*a*, the latch bar 26 includes a first side flange 27 and a second side flange 28 which facilitate the vertical movement of the latch bar 26 within the first and second notches 22 and 24 of the track member 16. The second side flange 28 of the latch bar 26 is received by the second notch 24 of the track member 16 and the first side flange 27 of the latch bar 26 is received by the first notch 22 of the track member 16. The first side flange and second side flange 27 and 28 are integral with and oppositely-extending outward from a midportion 29 (see FIG. 3*a*). The latch bar 26 includes a latch handle 30 that is coupled to the midportion 29 at an intermediate position thereon. The latch handle 30 is longitudinal in nature and includes a base portion 30*a* and an extending portion 30*b* which has an inturned edge 30*c*. The latch handle 30 is preferably formed from a hardened sturdy metallic material. The latch handle 30 is preferably coupled to the latch bar 26 by way of conventional standard bolts commonly used in the industry.

In referring more to FIG. 3, a lock bracket 31 can be seen in more detail as it is coupled to the latch bar 26 to facilitate the locking of the postal box 5. The lock bracket 31 is generally L-shaped in nature and includes a mounting portion 32, an integrally-extending engaging portion 34, and a central opening 36 positioned within the engaging portion 34. The mounting portion 32 of the lock bracket 31 is coupled to the midportion 29 by way of standard conventional bolts used commonly in the industry. The central opening 36 positioned in the integrally-extending engaging portion 34 serves to receive a dead bolt type of latch positioned on the second master door 14. The dead bolt type of latch mechanism is that of a conventional standard one used commonly in the industry.

In further referring to FIG. 3, latches 38 can be seen in their relative configuration in relation to the latch bar 26. The latches 38 include an anchoring plate 40 and a latch arm 42 that extends integrally outward from the anchoring plate 40. The latch arm 42 has a nose portion 44 that incorporates a vertical ramp 46 thereon (FIGS. 5*b* and 6*b* may better illustrate the shape of the latches 38). The latches 38 are coupled to the midportion 29 of the latch bar 26 by way of conventional standard bolts used commonly in the industry. Specifically, the conventional bolts are used to attach the anchoring plate 40 of each latch 38 to the midportion 29 of the latch bar 26. A total of three latches 38 are equally spaced along the latch bar 26 so as to present three points of latching to achieve the complete securement of the first and second master doors 12 and 14. In addition, the latch bar 26 includes an oval slit 48 positioned relative to an intermediate point along the latch bar 26. The oval slit 48 facilitates the passing through of a portion of the plunger assembly 50 so as to automatically force open the second master door 14 upon an unlocking of the dead bolt type of latch mechanism positioned on the second master door 14.

Figure 4A:
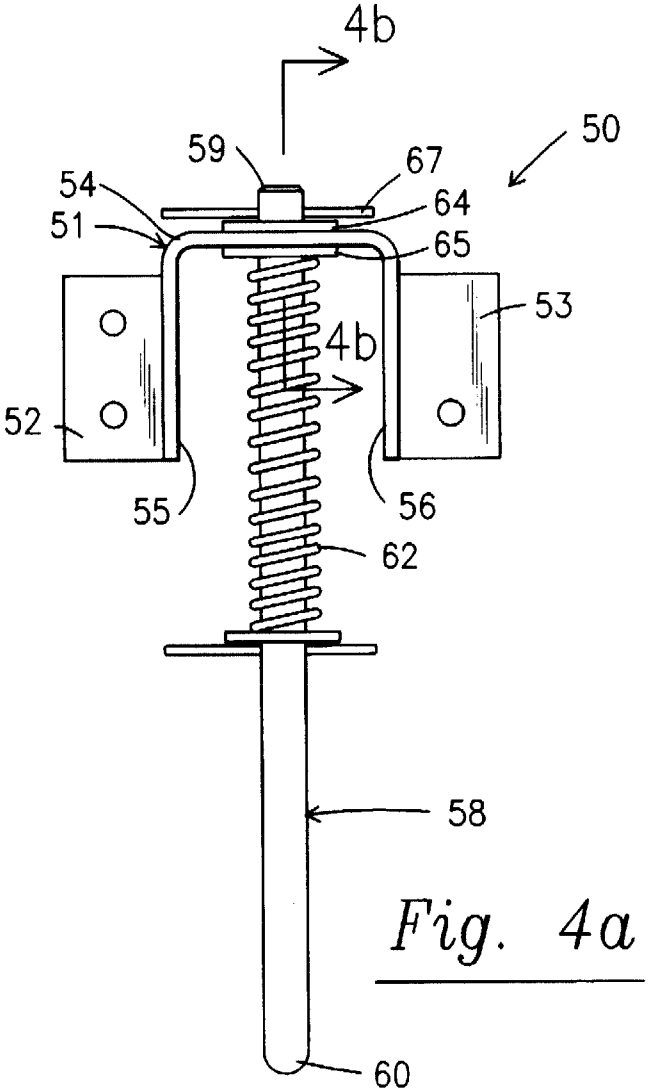
FIG. 4*a* and 4*b* are a top plan view and a cross-sectional side view taken along the line b—b of the plunger assembly illustrating the relative positions of the plunger bracket, the plunger, the compression spring and the first and second retaining means in their relative positions to each other.
Figure 4B:
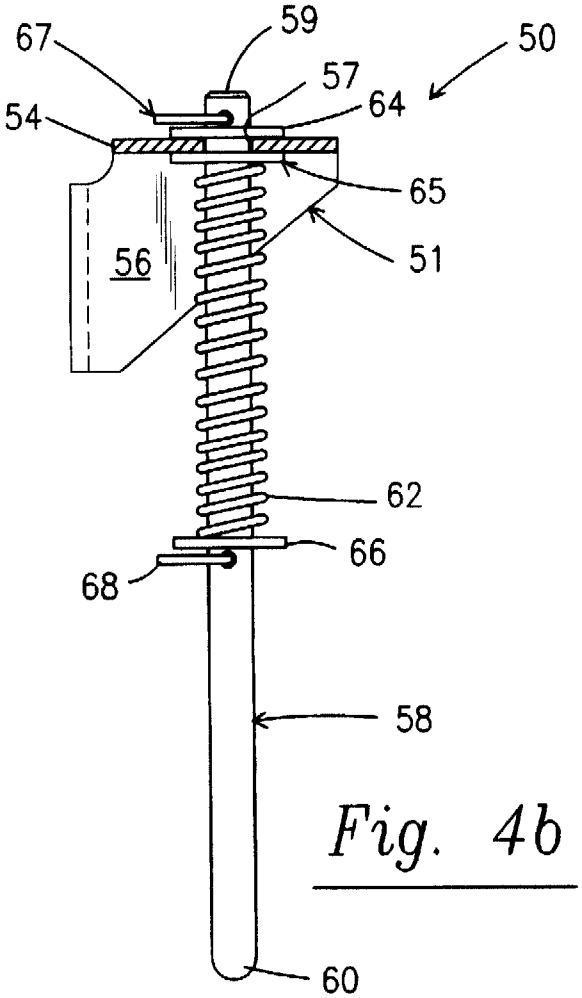

In now referring to FIGS. 4*a* and 4*b*, the plunger assembly 50 can be seen in more detail. A top plan view and a cross-sectional side view taken along line b—b of the plunger assembly is shown illustrating the relative positions of its various components. The plunger assembly 50 is comprised of a plunger bracket 51 having a first and second mounting flange 52 and 53, a back member 54, and a first and second side member 55 and 56. The first mounting flange 52 is integral with and extending outward from the first side member 55 and the second mounting flange is integral with and extending outward from the second side member 56. The first and second mounting flanges 52 and 53 extend outward from their respective side members 55 and 56 in a perpendicular manner. The back member 54 is integral with and interposed between the first and second side members 55 and 56 to form one integral structure.

The back member 54 further includes a central bore 57 therethrough. Passing through the central bore 57 is a plunger 58. The plunger 58 is generally cylindrical in shape and longitudinal in nature having a flat end 59 and a round end 60. The plunger 58 has a first retaining means positioned relative to the flat end 59 and a second retaining means positioned intermediate to the flat end 59 and the round end 60. A compression spring 62 is positioned circumferentially around the plunger 58 and interposed between the first retaining means and the second retaining means.

In coupling the plunger 58 to the plunger bracket 51, the plunger 58 is passed through the central bore 57 of the plunger bracket 51 such that the back member 54 of the plunger bracket 51 comes to rest adjacent the first retaining means. Next a second washer 65, of a conventional type commonly used in the industry, is positioned over the plunger 58 and slid into a position adjacent the back member 54. Once the second washer 65 is in position, the compression spring 62 is slid into place adjacent the second washer 65. Finally, the second retaining means positioned at the opposing end of the compression spring 62 is coupled to the plunger 58 so as to retain the compression spring 62 and plunger 58 relative to the plunger bracket 51. The first retaining means and the second retaining means are comprised generally of a first and third washer 64 and 66 and a first and second cotter pin 67 and 68. The first and second cotter pins 67 and 68 are positioned so as to perpendicularly pass through the cylindrical plunger 58.

Thus, when the second master door 14 is in the closed state, the plunger 58 is forced in a backwards movement so as to compress the compression spring 62 and thereby develop a potential energy therein. Hence, upon an unlocking of the dead bolt type latch mechanism and an upward movement of the latch bar 26, the second master door 14 is sprung open automatically due to the force exerted thereon by the plunger 58 which is being forced forward by the compression spring 62. The plunger bracket 51 is coupled to the center partition 10 by way of the first and second mounting flanges 52 and 53. The first and second mounting flanges 52 and 53 are secured to the center partition 10 by way of conventional bolts used commonly in the industry. Further, the plunger 58 engages the second master door 14 by way of passing through the first edge 11 of the center partition 10, the track member 16, and the oval slit 48 on the latch bar 26. The first, second and third washers 64, 65 and 66 are conventional washers used commonly in the industry. The first and second cotter pins 67 and 68 are preferably formed from spring steel so as to remain in place perpendicularly passing through the cylindrical plunger 58.

So as to complete the multiple latch system, latch plates 70 are positioned on the second master door 14 in cooperation with the corresponding latches 38 on the latch bar 26. The latch plates 70 are generally rectangular in shape and have a flat top edge 72. The latch plates 70 are fixed to the second master door 14 and operate so as to engage the nose portion 44 and vertical ramp 46 of the latches 38. In operation, when the first and second master doors 12 and 14 are closed, the top edge 72 of the latch plates 70 engage the vertical ramps 46 of the respective latches 38 so as to allow the extending latch arms 42 to pass over and come into releasably engaged contact therewith. Whereupon a subsequent upward vertical movement of the latch bar 26 then disengages the latch arms 42 from the latch plates 70 and the plunger 58, due to a forward force exerted on it by the compression spring 62, forces the second master door 14 open.

Figure 5B:
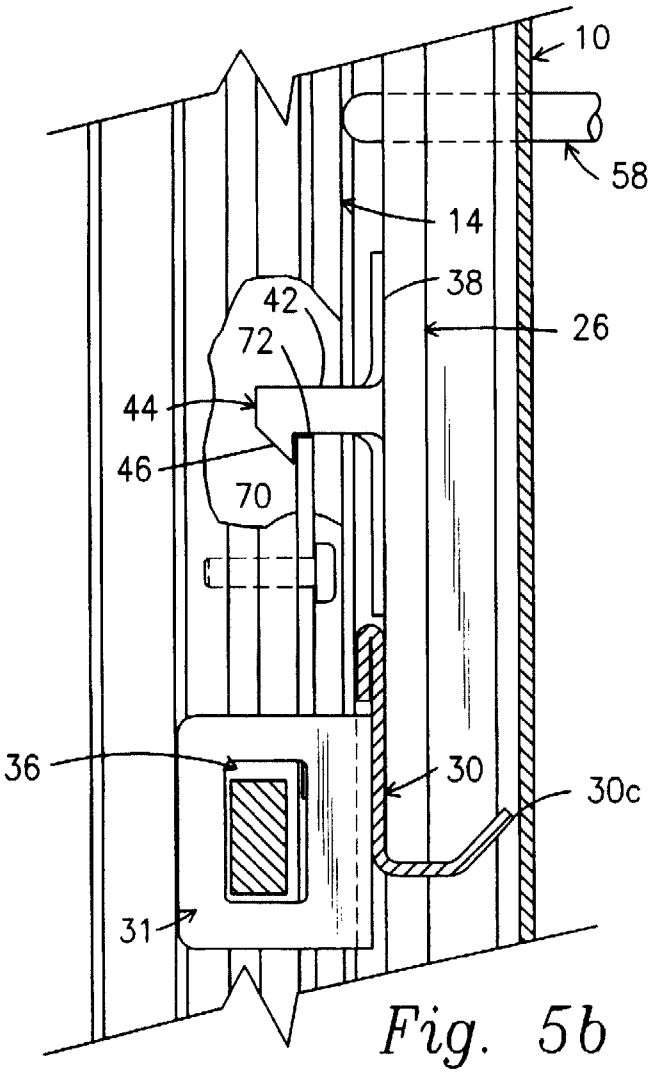
FIG. 5*b* is a vertical cross-sectional view of the master door showing the track member, the latch bar, a latch in engagement with a latch plate in their relative positions to each other.
Figure 5A:
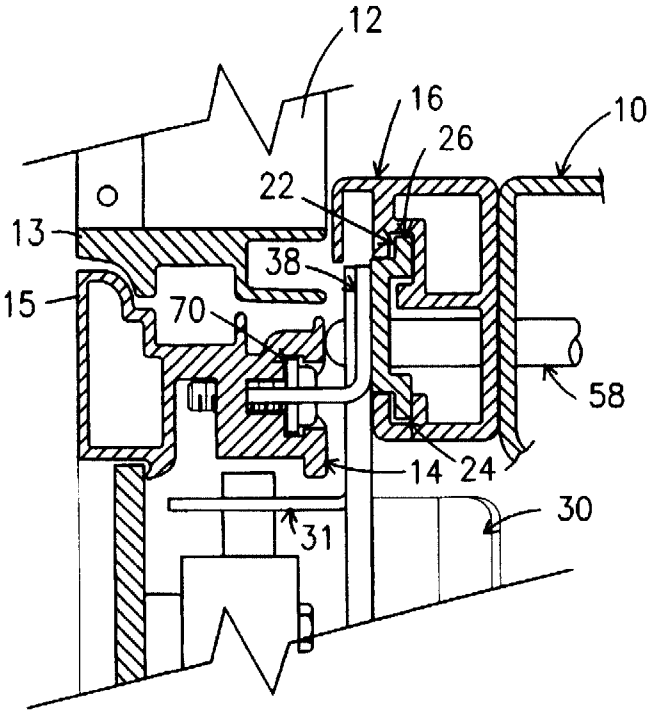
FIG. 5*a* is a cross-sectional top view showing the frame means, the latch bar, the latches, the latch plate, and the plunger in their relative positions to each other when the master doors are in a closed state.

In referring now to FIGS. 5*a* and 5*b*, the latching operation can be seen in more detail. FIG. 5*a* is a top cross-sectional view showing the first locking edge 13 of the first master door 12 and the second locking edge 15 of the second master door 14 in cooperation with one another when the second master door 14 is in a latched closed state. FIG. 5*b* is a vertical cross-sectional view of the second master door 14 showing the engaging cooperation of the latches 38 on the latch bar 26 with the latch plates 70 on the second master door 14.

Figure 6B:
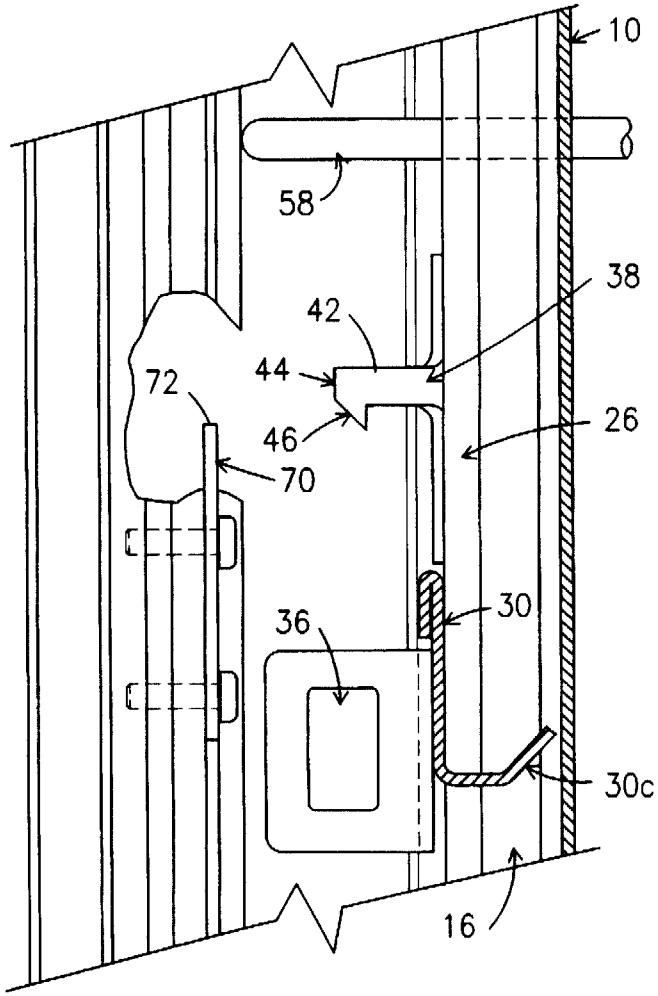
FIG. 6*b* is a vertical cross-sectional view of the master door in at open state showing the plunger passing through the track member and the latch bar to contact the master door and the latch disengaged from a latch plate.
Figure 6A:
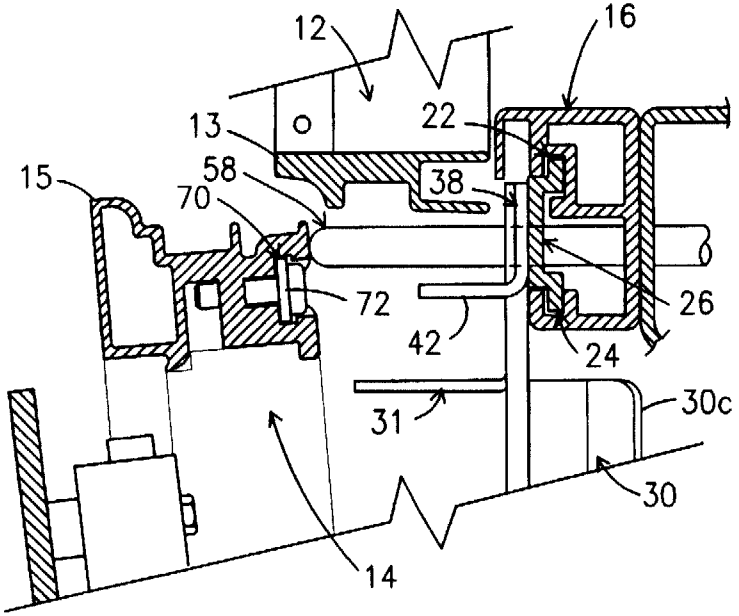
FIG. 6*a* is a cross-sectional top view of the master doors illustrating the cooperation of the doors to one another as well as the plunger forcibly opening the master door upon the disengagement of the latches upon an upward movement of the latch bar.

In referring now to FIGS. 6*a* and 6*b*, the forward action of the plunger 58 can be seen acting upon the second master door 14 when the dead bolt type latch mechanism is unlocked. FIG. 6*a* is a cross-sectional top view of the first and second master doors 12 and 14 with the plunger 58 causing the second master door 14 to be automatically opened upon the latches 38 being disengaged from the latch plates 70. FIG. 6*b* is a vertical cross-sectional view of the second master door 14 showing the second master door 14 being forced open by the plunger 58 upon the latches 38 being disengaged from the latch plates 70.

Therefore, in operation, the latch bar 26 is forcibly moved upward sliding along the track member 16 and resultingly disengaging the latches 38 from the latch plates 70. The latch bar 26 is forcibly moved upwards along the track member 16 by way of the latch handle 30 being pulled upwards. Access to the latch handle 30 is gained by way of unlocking the deadbolt type latch mechanism that passes through the central opening 36 of the lock bracket 31. Once the dead bolt type latch mechanism is unlatched, a single respective mail slot door is opened exposing the latch handle 30. Thus, a mailbox cluster containing many individual mail slots can be accessed simultaneously by way of opening one single lock and lifting up on the latch handle 30 to disengage the latches 38 whereupon the first and second master doors 12 and 14 are opened.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A multiple point latching system for use on a postal box, the postal box having one vertical side and an opposite vertical side, a first master door hingedly coupled along the one vertical side of the postal box, a second master door hingedly coupled along the opposite vertical side of the postal box, and a center partition positioned within the postal box, whereby the first and second master doors close so to meet adjacent the center partition, said latching system comprising in combination:

a latch bar, said latch bar being slidably coupled relative to the center partition, said latch bar including a plurality of latches;

a track member coupled vertically along the center partition, wherein said track member slidably contains said latch bar and facilitates vertical movement thereof;

a plunger assembly, said plunger assembly being coupled to said center partition and applying a force on at least one master door so to force at least one master door open upon an upward movement of said latch bar a sufficient distance to allow said plunger assembly to activate; and a plurality of latch plates, said latch plates being positioned on at least one master door whereby said latch plates engage respective said plurality of latches on said latch bar so to secure at least one master door in a closed position, whereby said latch bar is forced upwards to release said plurality of latches and said plunger assembly forces at least one master door open.

2. The multiple point latching system as recited in claim 1, wherein each of said latches is comprised of an extending arm having a nose portion with a vertical ramp thereon to facilitate the movement of said nose portion over said latch plate to thereby forcibly engage said latch plate.

3. The multiple point latching system as recited in claim 1, wherein said plunger assembly further comprises a plunger bracket having a bore, said plunger bracket being coupled to the center partition, a plunger cylindrical in shape and having a flat end, a round end, a first retaining means protruding radially outward therefrom positioned adjacent said flat end, and a second retaining means protruding radially outward therefrom positioned intermediate to said flat end and said round end, said plunger being positioned so to pass through said bore in said plunger bracket and said first retaining means to facilitate preventing said plunger from disengaging from said plunger bracket, a compression spring positioned circumferentially around said plunger and interposed between said plunger bracket and said second retaining means whereby said compression spring provides a force on said plunger.

4. The multiple point latching system as recited in claim 3, wherein said first and second retaining means include a washer and a cotter pin.

5. The multiple point latching system as recited in claim 2, wherein said latch bar includes an oval slit therein so to facilitate said plunger passing through said latch bar to forcibly engage at least one master door.

6. The multiple point latching system as recited in claim 5, wherein said latch bar further includes a latch handle, said latch handle facilitating an upwards motion of said latch bar to thereby disengage said latches from said latch plates.

7. The multiple point latching system as recited in claim 1, wherein said track member is generally U-shaped in nature and includes an internal side, a first groove and a second groove positioned opposite each other and on said internal side so to slidably receive said latch bar.

8. A multiple point latching system for use on a postal box, the postal box having one vertical side and an opposite vertical side, a first master door hingedly coupled along the one vertical side of the postal box, a second master door hingedly coupled along the opposite vertical side of the postal box, and a center partition positioned within the postal box, whereby the first and second master doors close so to meet adjacent the center partition, said latching system comprising in combination:

a track means for providing slidable movement therealong, said track means being coupled to the center partition of the postal box;

a latching means for securing at least one master door in a closed position, said latching means being slidably coupled to said track means; and a plunger means for providing a force so to forcibly open at least one master door upon said latching means being slid upwards a sufficient distance to allow said plunger means to activate.

9. A multiple point latching system as recited in claim 8, wherein said latching means is comprised of a latch bar slidably coupled relative to the center partition, a plurality of latches coupled to said latch bar, and a plurality of latch plates coupled to at least one master door.

10. A multiple point latching system as recited in claim 9, wherein each of said plurality of latches is further comprised of an extending arm having a nose portion with a vertical ramp thereon to facilitate the movement of said nose portion over said latch plate to thereby forcibly engage said latch plate.

11. A multiple point latching system as recited in claim 10, wherein said latch bar further includes a latch handle, said latch handle facilitating an upwards motion of said latch bar to thereby disengage said latches from respective said latch plates.

12. A multiple point latching system as recited in claim 8, wherein said plunger means is comprised of a plunger assembly including a plunger bracket having a bore, said plunger bracket being coupled to the center partition, a plunger cylindrical in shape and having a flat end, a round end, a first retaining means protruding radially outward therefrom positioned adjacent said flat end, and a second retaining means protruding radially outward therefrom positioned intermediate to said flat end and said round end, said plunger being positioned so to pass through said bore in said plunger bracket and said first retaining means to facilitate preventing said plunger from disengaging from said plunger bracket, a compression spring positioned circumferentially around said plunger and interposed between said plunger bracket and said second retaining means whereby said compression spring provides a force on said plunger.

13. A multiple point latching system as recited in claim 9, wherein said track means comprises a track member of a generally U-shape nature, said track member further including an internal side, a first groove and a second groove positioned opposite each other and on said internal side so to slidably receive said latch bar.

* * * * *